US011136230B2

(12) United States Patent
Naukam

(10) Patent No.: US 11,136,230 B2
(45) Date of Patent: Oct. 5, 2021

(54) APPARATUS FOR OPENING SAFETY LOCKED BOTTLE CAPS

(71) Applicant: Kurt Naukam, Castroville, TX (US)

(72) Inventor: Kurt Naukam, Castroville, TX (US)

( * ) Notice: Subject to any disclaimer, the term of this patent is extended or adjusted under 35 U.S.C. 154(b) by 264 days.

(21) Appl. No.: 16/296,151

(22) Filed: Mar. 7, 2019

(65) Prior Publication Data

US 2019/0276294 A1 Sep. 12, 2019

Related U.S. Application Data

(60) Provisional application No. 62/640,576, filed on Mar. 9, 2018.

(51) Int. Cl.
*B67B 7/18* (2006.01)
*B65D 50/02* (2006.01)

(52) U.S. Cl.
CPC ..... *B67B 7/18* (2013.01); *B65D 50/02* (2013.01); *F17C 2209/236* (2013.01)

(58) Field of Classification Search
CPC .... B67B 7/14; B67B 7/16; B67B 7/18; B67B 7/403; B67B 7/44; B67B 7/406; B65D 50/02; B65D 23/104; B65D 41/16; B65D 50/00; F17C 2209/236
See application file for complete search history.

(56) References Cited

U.S. PATENT DOCUMENTS 941,865 A * 11/1909 Wallace ..... B67B 7/16 81/3.55
2,576,000 A * 11/1951 Cowan, Jr. ..... B67B 7/16 81/3.55
4,409,864 A * 10/1983 Gaskins ..... B67B 7/16 81/3.55
2005/0189313 A1* 9/2005 Walters, Jr. ..... B65D 47/127 215/305
2007/0079670 A1* 4/2007 Chaconas ..... B67B 7/18 81/3.55
2013/0327184 A1* 12/2013 Nelson ..... B67B 7/16 81/3.09

* cited by examiner

*Primary Examiner* — Robert J Scruggs
(74) *Attorney, Agent, or Firm* — Shah IP Law, PLLC

(57) ABSTRACT

An apparatus for opening safety locked bottle caps is disclosed herein. The apparatus enables users to open safety locked bottle caps in a safe and effective manner. In one embodiment of the invention, the various elements of the inventive apparatus enable a user to remove a bottle cap when sufficient downward force is applied to the handle of the apparatus. In one embodiment, the apparatus is comprised of an engagement mechanism that lodges into the bottom portion of the bottle cap's outer lip. The engagement mechanism is designed to remain lodged within the bottle cap's outer lip through a substantial portion of the opening motion. This feature prevents the inventive apparatus from "slipping-off" from the bottle cap while a user is trying to remove the bottle cap from the bottle.

8 Claims, 3 Drawing Sheets

APPARATUS FOR OPENING SAFETY LOCKED BOTTLE CAPS

CROSS-REFERENCE TO RELATED APPLICATIONS

This application claims priority to U.S. Provisional Patent Application Ser. No. 62/640,576, filed Mar. 9, 2018, entitled "Apparatus for opening safety locked bottle caps." The entire content of that application is incorporated herein by reference.

BACKGROUND

Field of the Art

This disclosure relates to devices and methods for removing a bottle cap from a bottle.

Discussion of the State of the Art

Safety locked bottle caps, such as bottle caps for pill or medicine bottles, are, by design, difficult to open. These bottles are designed to prevent kids from opening the bottles and removing its content, which may be dangerous if consumed by a child. As a result, these types of bottle caps typically require significant strength (or application of pressure), and a specific set of coordinated movements in order to permit adults to open the bottles, while, at the same time, preventing kids, who may not have the requisite strength or the coordination, from opening the bottle An unfortunate side-effect of this design is that safety locked bottle caps are often difficult to open for adults as well. For example, elderly and/or people who are injured or have some loss of limb function find it extremely difficult to open these types of bottle caps. Moreover, pharmacists, who open safety locked bottles caps throughout the day, tend to suffer from repetitive stress injuries at their wrists, elbows and related joints as a result of repeatedly applying pressure and moving their wrists and forearms in a specific manner required to open the bottles.

There are a variety of different bottle cap openers that help users open bottle caps. For example, lever type openers pry open a bottle cap by transferring force applied by a user or a device, and applying leverage to the bottle cap. Push type openers remove bottle caps by applying downward pressure and activating an opening mechanism.

These tools, however, are difficult to use and are ineffective at opening safety locked bottle caps, which—unlike traditional bottle caps—have a specialized locking mechanisms and structure. For example, conventional crow-bar type openers often slip-off safety locked bottle caps and, for that reason, are notoriously difficult to use on safety locked bottle caps. Moreover, prybar-type openers irreversibly damage the bottle caps or catch the threads on a bottle, which renders the battle unsuitable for future use. Other, push-type openers are bulky, and often require a user to apply an equal or similar amount of force as would be required to open the bottle cap without an assistance device—and, as such, are not very helpful in alleviating the problems outlined above.

SUMMARY

The inventor has conceived and reduced to practice an apparatus for opening safety locked bottle caps. The inventive apparatus is comprised of an engagement point that lodges into the bottom surface of the outer ring of a bottle cap, a fulcrum to leverage and/or transfer force from a user to the bottle cap, and an extension member connecting the fulcrum to the engagement point.

A feature of the present invention is that it is easy to use. Unlike traditional prybar-type bottle openers, which often slip-off from the bottle cap during the opining or prying motion, the apparatus of the present invention lodges into a portion of the bottle cap. As such, the inventive apparatus does not "slip-off" from the bottle when force is applied to open the bottle cap. Moreover, traditional piggy bar-type openers also slip-off during the opening motion (which may be caused by the rotational motion applied by the user) as the direction of the force changes with respect to the cap. The inventive apparatus of the present invention solves that problem by ensuring that the apparatus remains lodged, or connected, with the bottle cap regardless of the direction of force applied by the user relative to the bottle cap throughout the prying motion or the opening motion.

Another feature of the present invention is that it does not damage the safety locked bottle cap or render it unusable in the future. Traditional pry bar-type bottle openers force the bottle cap to temporarily bend or distort in an outward direction away from the bottle when prying force is applied to the prybar. However, this feature causes the inner and outer walls of cap and/or threads in the interior of the cap to bend or distort—rendering the cap unusable for future use due to a permanent bend in the cap or misalignment with the threads of a bottle cap. However, the apparatus of the present invention lodges into the bottom outer diameter of the bottle cap and applies substantially upward pressure. This application may cause some minor damage to the bottom outer diameter of the bottle cap, but, importantly, does not cause significant damage to the outer walls or the interior threads of the bottle cap—thereby preserving the functionality and use of the bottle cap well into the future.

Another feature of the inventive apparatus is that it fits—and effectively opens—a wide variety of different bottle caps, including battle caps of various shapes and diameters. Traditional prybar-type openers tend to be more effective at opening bottle caps of a particular shape and size (for example, a size and shape that complements the size and shape of the opener). However, traditional openers often fail to properly latch when the opener is used to open bottle caps of other, different, shapes and sizes. The inventive apparatus of the present invention lodges into the bottom lip of the bottle cap near the bottle lip's inner circumference, or in the space between the outer lip's circumference and the bottle. As a result, the inventive apparatus is effective at opening battle caps even if the circumference of the bottle lip is changed. Moreover, the apparatus of the present invention is comprised of a fulcrum that fits on a variety of different bottle cap shapes and sizes. Indeed, one aspect of the present invention is that The inventive apparatus for opening safety locked bottle caps disclosed herein may be comprised of an engagement mechanism for engaging a bottom surface of a bottle cap's outer lip, a depth gauge for guiding the engagement mechanism to an appropriate point on the bottle cap's bottom surface, a fulcrum for distributing the force required to open a safety locked bottle cap, the fulcrum resting over the top surface of the bottle cap when the apparatus is fitted over the bottle cap, a handle for permitting a user to apply force to the apparatus for opening a safety locked bottle cap, and an extension member for connecting the engagement mechanism and the depth gauge to the fulcrum and the handle.

In one embodiment, the engagement mechanism of inventive apparatus may be a cleat that lodges into the bottom surface of the bottle cap's outer lip when the apparatus is appropriately fitted over the bottle cap. In one embodiment, the engagement mechanism may be further comprised of an engagement point that lodges into the bottom surface of the bottle cap's outer lip when the apparatus is appropriately fitted over the battle cap. In one embodiment, the engagement mechanism may be an overhang that extends beyond the depth gauge. The overhang may extend towards the interior portion of the apparatus in a direction that is parallel to the handle of the apparatus. Moreover, the overhang may extend at an acute angle from the depth gauge. In one embodiment, the angle formed by the overhang and the depth gauge may be determined by the angle formed between the extension member and the handle. In one embodiment, a smaller angle between the extension member and the handle may result in a greater angle between the depth gauge and the engagement mechanism. In one embodiment, the fulcrum may rest against the top surface of a bottle cap when the apparatus is appropriately fitted over the bottle cap. The term appropriately fitted, as described herein, means when the apparatus is securely positioned over the bottle cap such as when the engagement mechanism is placed under the bottom surface of the bottle cap's outer lip and the fulcrum is placed over the top surface of the bottle cap in a manner that permits a user to engage in a plying motion to open the bottle cap. In other words, appropriately fitted means when the engagement mechanism is placed on a point on the bottom surface of the bottle cap and the fulcrum is placed over the top surface of the bottle cap. The fulcrum may, in accordance to an embodiment of the invention, distribute the force required to open the bottle cap across a portion of the bottle cap and through the curvature of the fulcrum. Moreover, in a preferred embodiment, the fulcrum is semi-circular in shape.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION

Figure 1:
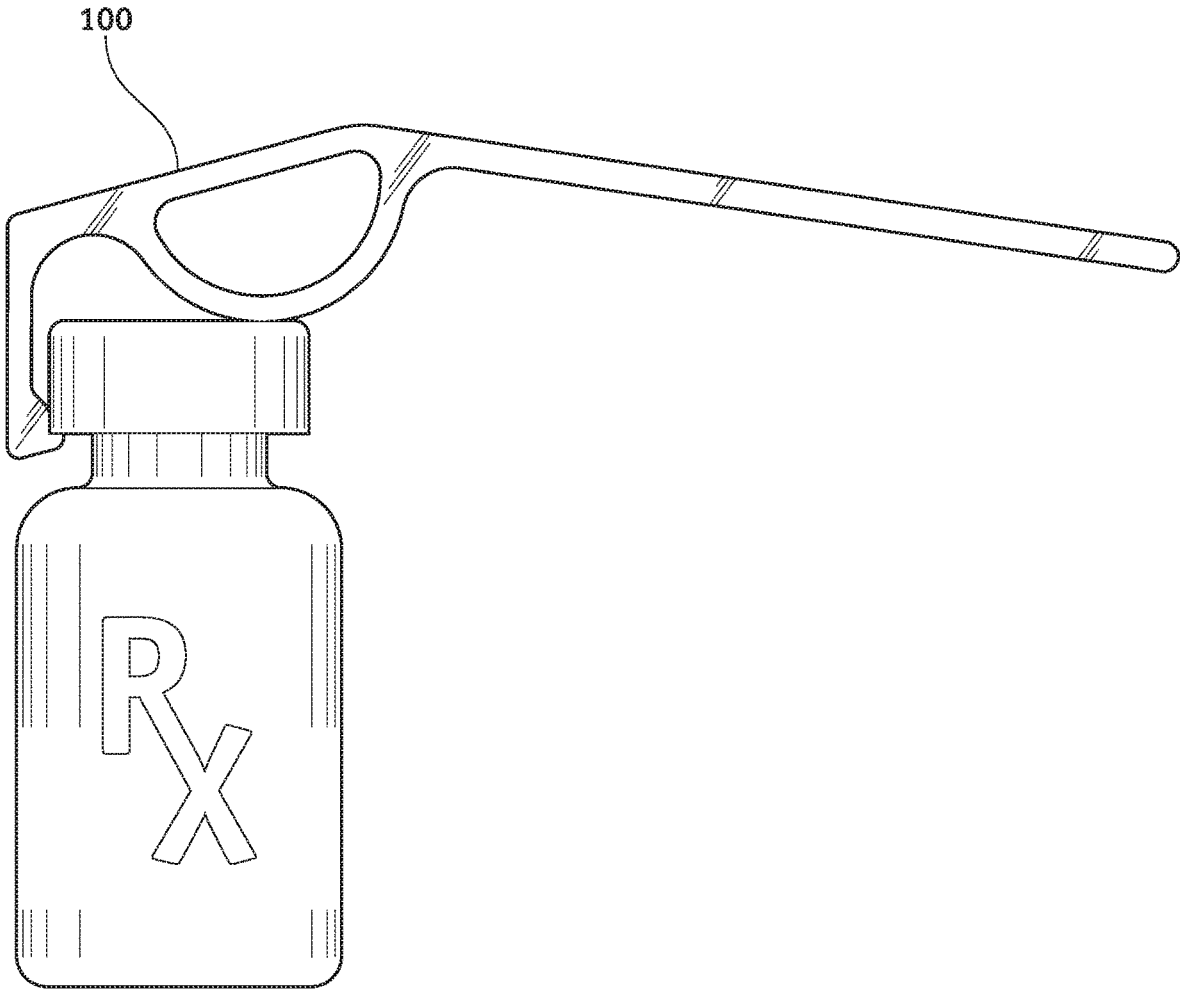
FIG. 1 illustrates an inventive apparatus of the present invention in accordance with an embodiment of the invention.

The inventor has conceived, and reduced to practice, an apparatus for opening safety locked bottle caps. In one embodiment of the invention, the apparatus includes an engagement mechanism, a depth gauge, a fulcrum, and a handle. The various components of the apparatus make it easier to open a safety locked bottle cap by ensuring that the apparatus remains engaged with the bottle cap throughout the opening motion (i.e. the motion for opening the bottle cap by ensuring that the apparatus does not "slip off" from the cap once engaged, redistributing the force required to open the bottle cap, and changing the direction of the force required to open the bottle cap.

The invention is described by reference to various elements herein. It should be noted, however, that although the various elements of the inventive apparatus are described separately below, the elements need not necessarily be separate. The various embodiment may be interconnected and may be cut out of a singular block or mold. The variety of different ways of forming an inventive apparatus, in accordance with the disclosure herein, may be varied without departing from the scope of the invention.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

Overview

The apparatus of the present invention is prybar-type device that enables users to open safety locked bottle caps in a safe and effective manner. In one embodiment of the invention, the various elements of the inventive apparatus enable a user to remove a bottle cap when sufficient downward force is applied to the handle of the apparatus. In one embodiment, the apparatus is comprised of an engagement mechanism that lodges into the bottom portion of the bottle cap's outer lip. The engagement mechanism is designed to remain lodged within the bottle cap's outer lip through a substantial portion of the opening motion (and/or resulting rotation that may be applied to the bottle cap during the opening motion). This feature prevents the inventive apparatus from "slipping-off" from the bottle cap while a user is trying to remove the bottle cap from the bottle. Moreover, this feature enables a user to apply pressure in a substantially upward direction, enabling the user to apply less pressure or leverage to open a bottle cap as compared to prior art devices that typically apply pressure in an upward and lateral direction. Finally, the engagement mechanism is designed to ensure that the outer walls and interior threads of the bottle cap (which mate with the outer threads of a bottle) do not become damaged via the use of the apparatus.

The inventive apparatus with the engagement mechanism described herein may be used in an apparatus that is comprised of a depth gauge a depth gauge for guiding the engagement mechanism to an appropriate portion of a bottle cap, a fulcrum for redistributing the force required to open a safety locked bottle cap, a handle for permitting a user to apply force to the apparatus for opening a safety locked bottle cap, and an extension member for connecting the engagement mechanism and the depth gauge to the fulcrum and the handle.

The inventive apparatus may also be used in a system for opening safely locked bottle caps. In one embodiment, the apparatus may be used in conjunction with a holder, which secures the bottle to a table or a placement area. The apparatus may then be used to open the safety locked bottle cap while the bottle remains secured in a holder on a table top or other similar surfaces. In such an embodiment, the handle of the apparatus may be shaped or curved differently than as illustrated in the various figures provided herein to ensure that the handle does not make contact with the table top surface during the opening motion. The apparatus may be used in conjunction with other systems and methods for opening safety locked bottle caps without departing from the scope of the invention.

Apparatus

FIG. 1 illustrates the inventive apparatus 100 in accordance with an embodiment of the invention. In particular, FIG. 1 illustrates the inventive apparatus 100 engaging a safety locked bottle cap that is attached to a pill bottle. As described herein, the inventive apparatus 100 engages the safety locked bottle cap, and, when the sufficient downward pressure is applied to a handle portion of the inventive apparatus 100, the inventive apparatus 100 removes the bottle cap from the pill bottle.

Although the description herein primarily discusses pill bottles, the inventive apparatus 100 may be used with a variety of different containers, including food, beverage, and/or pill bottles. The inventive apparatus 100 may work with a variety of different bottle caps as well, including bottle caps with safety lock mechanisms. A variety of different safety lock mechanisms may employed on bottle caps that may be opened by the inventive apparatus 100.

Figure 2:
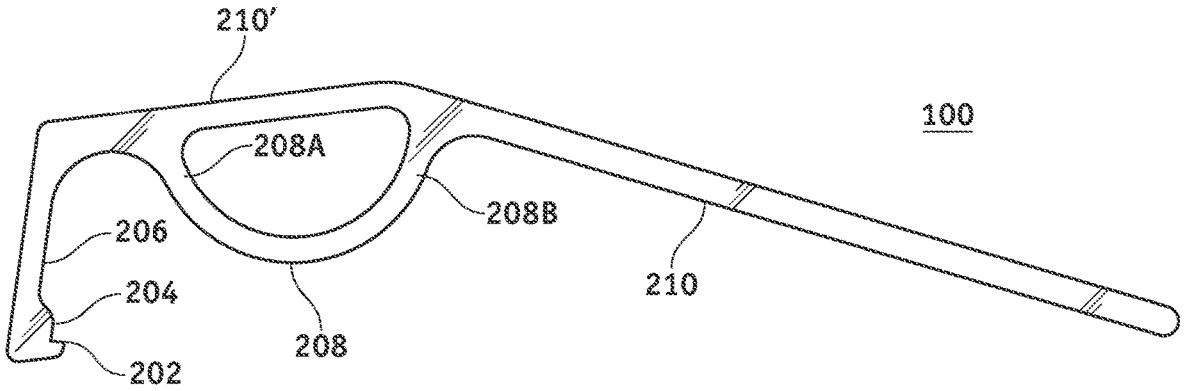
FIG. 2 illustrates an inventive apparatus of the present invention in accordance with an embodiment of the invention.

FIG. 2 illustrates the various components of the inventive apparatus 100, which may be comprised of an engagement mechanism 202, a depth gauge 204, an extension member 206, a fulcrum 208, and a handle 210. The specific components illustrated in FIG. 2, and described herein, may be varied in accordance with this specification without departing from the scope of the invention to the extent that the components enable a user to open a safety locked bottle cap with ease.

The engagement mechanism 202 engages the bottom surface of a bottle cap's outer lip/outer circumference. In one embodiment, the outer edge of the engagement mechanism 202 hooks into, digs into, and/or lodges into the bottom surface of the bottle cap's outer lip when the apparatus 100 is appropriately fitted over the bottle cap. The engagement mechanism 202 remains lodged into the bottom surface of the bottle cap's outer rim throughout the opening motion, which causes upward pressure to be applied to the bottle cap. When sufficient pressure is applied, the bottle cap disengages the threads (or other closure system) on the bottle and becomes removed from the bottle. Moreover, because the engagement mechanism 202 is securely lodged into the bottle cap's outer rim, the apparatus 100 does not slip off, or disengage from the bottle cap during the opening motion, which makes it easier and safer for a user to use the inventive apparatus 100. For example, it is easier to use the inventive apparatus 100 because it does not slip-off, which results in fewer failed open attempts. Moreover, because the inventive apparatus 100 does not slip off, or slips off less frequently, the user is less likely to hit his or her hand or forearms on nearby surfaces as a result of failed attempts as a result of the device slipping off from the bottle or bottle cap. In one embodiment of the invention, the engagement mechanism 202 may be comprised of an engagement point 302 and an overhang, which are described in greater detail in reference to FIG. 3.

Figure 3:
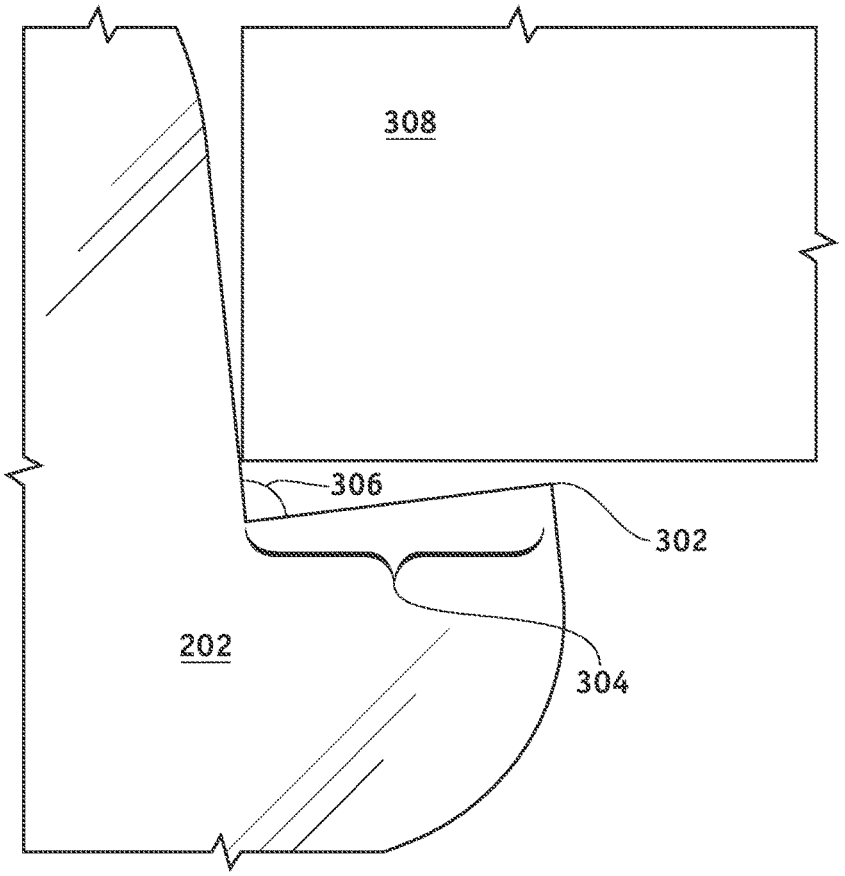
FIG. 3 illustrates a portion of the inventive apparatus of the present invention in accordance with an embodiment of the invention.

Referring now to FIG. 3, it illustrates the various components of the engagement mechanism 202, including an engagement point 302, and an overhang 304. The engagement point 302 engages the outer lip of a bottle cap when the apparatus 100 is placed over the bottle cap. Specifically, the engagement point 302 represents a sharp edge that is capable of digging into and/or lodging into the bottom surface of the rim along the outer circumference of the bottle cap. In other embodiments, other mechanisms for engaging or temporarily coupling the engagement point 302 to the bottle cap's outer rim may be used, including, but not limited to a hook, nail, cleat, screw, etc., without departing from the scope of the invention. In one embodiment, the engagement point 302 may be comprised of multiple sharp edges, hooks, nails, cleats, screws, etc. The engagement point 302 may be designed to lodge into a variety of different bottle cap materials, including plastic, composites, etc.

The overhang 304 extends from the depth gauge 204. It serves to deliver the engagement point 302 to an appropriate location on a bottle cap's outer rim. If the overhang 304 is too long, then the engagement point will extend to the space between the bottle cap and the bottle, thereby failing to engage the bottle cap appropriately. If the overhang 304 is too short then the engagement point 302 would engage the extreme outer edge of the bottle cap's lip, which may damage or tear the bottle cap. The specific length of the overhang 304 may vary based on the variety of different types of bottle caps that the apparatus 100 may be designed to open. In one embodiment, the overhang 304 is 0.08 inches. In another embodiment, the overhang 304 But other lengths may be used without departing from the scope of the invention.

The overhang 304 also extends at an angle 306 from the depth gauge 204. In one embodiment, the angle 306 is less than 90 degrees. The acute angle ensures that the engagement point 302 engages the bottle cap effectively, i.e. the acute angle ensures that the engagement end point 302 actually lodges into the bottom surface of the bottle cap's outer rim. If the angle is greater than 90 degrees, then the top surface of the overhang 304 may abut the bottom end of the bottle cap before the engagement point 302 digs into the bottle cap, thereby reducing the effectiveness of the apparatus 100. The specific acute angle 306 that may be used may vary depending on the angle between the extension member 206 and, the handle 210, as described in greater detail below.

Referring again to FIG. 2, the depth gauge 204 guides the engagement mechanism 202 to an appropriate portion of the bottle cap's outer lip. In one instance, the depth gauge 204 acts as a stop gauge to ensure that the engagement mechanism 202 engages an appropriate portion of the bottle cap's outer rim, i.e. the depth gauge 204 ensures that the engagement mechanism 202 doesn't overshoot, or go beyond, the bottle cap's inner wall, and towards the outer edge of a bottle's threads. In other words, without the depth gauge 204, the engagement mechanism may fail to engage the bottle cap's outer lip and may engage a portion of the threaded inner cap, which may damage the cap when an opening or prying motion is applied to the cap. In another instance, the depth gauge 204 ensures that engagement mechanism 202 does not engage the extreme outer edge of the bottle cap's outer lip, which may cause damage to a portion of the bottle cap, thereby causing the outer surface of the bottle cap to tear. Moreover, the depth gauge 204 ensures that the engagement mechanism 202 remains engaged or lodged into the bottle cap's outer rim throughout the opening motion or prying motion without slipping off. In one embodiment of the invention, the engagement mechanism 202 is oriented in the direction that is parallel but opposite to the handle 210 (i.e. angled towards the extension element 206). This ensures that the engagement mechanism 202 remains in continuous contact with the lip throughout the opening or prying motion. Moreover, the acute angle between the depth gauge 204 and the engagement mechanism 202 ensures that the entire top surface of the engagement mechanism 202 does not contact the bottom surface of the bottle cap's outer lip. In other words, this angle ensures that the engagement point remains properly lodged in the bottle cap throughout the opening or the prying motion.

The extension member 206 extends at an angle from the handle 210. In one embodiment, the extension member 206 connects the depth gauge 204 with the handle 210. In other embodiments, however, the extension member 206 and the depth gauge 204 may be one and the same. For example, in FIG. 2, the depth gauge 204 is illustrated as extending beyond the extension member 206 towards the engagement mechanism 202. However, in another embodiment, the depth gauge 202 may extend all the way up to the handle 210 parallel to the extension member 206.

The specific angle formed by the extension member 206 and the handle 210 may vary. In one embodiment, the angle varies based on the slope of the engagement mechanism 202. A smaller angle between the extension member 206 and the handle 210 ma result in a greater angle between the depth gauge 204 and the engagement mechanism 202. In other words, the apparatus 100 is designed to ensure that the engagement mechanism 202 remains maximally engaged with the outer rim of a safety bottle cap throughout the opening motion.

Figure 4:
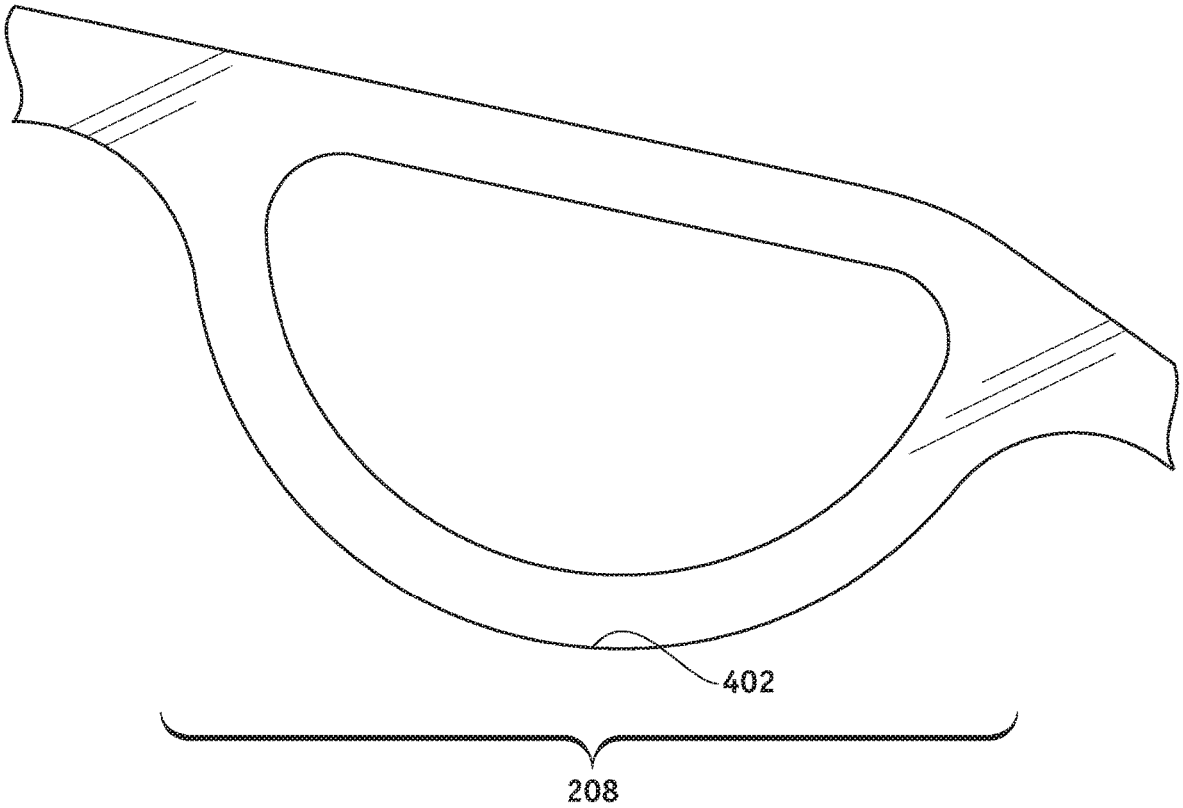
FIG. 4 illustrates a portion of the inventive apparatus of the present invention in accordance with an embodiment of the invention.

Referring now to FIG. 4, it illustrates the fulcrum 208 in greater detail. The fulcrum 208 rests against the top surface of a bottle cap when the apparatus 100 engages the bottle cap, and distributes the force required to open the bottle cap across a portion of the bottle cap and through the curvature of the fulcrum 208.

The fulcrum 208 may have a variety of different shapes and sizes in accordance with the disclosure herein. For example, the fulcrum 208 may have a circular or a semi-circular shape, which transfers force throughout the opening motion. Any other shape that applies an upward force to the bottle cap at the point where the engagement mechanism 202 contacts the bottle cap when downward angular force is applied to the handle 210, may be used without departing from the scope of the invention. A semi-circular shape is used in a preferred embodiment because it accommodates a variety of different bottle diameters.

In one embodiment, the fulcrum 208 may be comprised of a contact point 402, which typically contacts the outer top portion of the bottle cap when the apparatus is appropriately tilted over the bottle cap. It should be noted that the specific contact point 402 of the fulcrum 208 may vary depending on the diameter of the bottle cap and/or the orientation of the apparatus required to have it fit over and around the bottle cap. For example, the contact point 402 may be closer to the extension portion or closer to the handle depending on the diameter and/or the shape of the bottle cap and/or the specific shape and size of the various elements in the apparatus.

Referring again to FIG. 2, the apparatus 100 includes a handle 210. The handle permits a user to grip the apparatus 100 and apply downward angular force to it. The applied force is transferred to the engagement mechanism 202 via the fulcrum 208. In one embodiment, the handle has a downward sloping angle, but any shape or angle may be used without departing from the scope of the invention, including an upward sloping angle. For example, in the embodiment depicted in FIG. 2, the handle 210 includes a first handle portion 210 and a second handle portion 210' that extends at an angle relative to the first handle portion 210. The fulcrum 208 has a first end 208B that is coupled directly to the first handle portion 210 and a second end 208A that is coupled directly to the second handle portion 210'. The extension member 206 extends directly from the second handle portion 210'

Additional Considerations

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, or refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

What is claimed is:

1. An apparatus for opening safety locked bottle caps comprising:

an engagement mechanism for engaging a bottom surface of a bottle cap's outer lip;

a depth gauge for guiding the engagement mechanism to an appropriate point on the bottle cap's bottom surface;

a fulcrum for distributing the force required to open a safety locked bottle cap, the fulcrum resting over the top surface of the bottle cap when the apparatus is fitted over the bottle cap;

a handle for permitting a user to apply force to the apparatus for opening a safety locked bottle cap, wherein the handle comprises a first handle portion and a second handle portion that extends at an angle relative to the first handle portion; and an extension member for connecting the engagement mechanism and the depth gauge to the fulcrum and the handle, wherein the extension member extends directly from the second handle portion, wherein the fulcrum comprises a first end coupled directly to the first handle portion and a second end coupled directly to the second handle portion.

2. The apparatus of claim 1, wherein the engagement mechanism is a cleat that lodges into the bottom surface of the bottle cap's outer lip when the apparatus is appropriately fitted over the bottle cap.

3. The apparatus of claim 1, wherein the engagement mechanism is further comprised of an engagement point that lodges into the bottom surface of the bottle cap's outer lip when the apparatus is appropriately fitted over the bottle cap.

4. The apparatus of claim 1, wherein the engagement mechanism is an overhang that extends beyond the depth gauge.

5. The apparatus of claim 4, wherein the overhang extends at an acute angle from the depth gauge.

6. The apparatus of claim 1, wherein the fulcrum rests against the top surface of a bottle cap when the apparatus is appropriately fitted over the bottle cap.

7. The apparatus of claim 1, wherein the fulcrum distributes the force required to open the bottle cap across a portion of the bottle cap and through a curvature of the fulcrum.

8. The apparatus of claim 1, wherein the fulcrum is semi-circular in shape.

* * * * *